United States Patent [19]

Medd

[11] Patent Number: 4,522,505

[45] Date of Patent: Jun. 11, 1985

[54] ROTOR FOR LIQUID MIXING DEVICE

[75] Inventor: Ronald A. Medd, Bettendorf, Iowa

[73] Assignee: C. R. Medd & Sons, Bettendorf, Iowa

[21] Appl. No.: 650,948

[22] Filed: Sep. 17, 1984

[51] Int. Cl.[3] ..... B01F 7/18

[52] U.S. Cl. ..... 366/343; 366/197; 366/279; 366/329

[58] Field of Search ..... 366/197, 279, 329, 343, 366/605, 325

[56] References Cited

U.S. PATENT DOCUMENTS

| | | | |
|---|---|---|---|
| 929,038 | 7/1909 | Smith | 366/329 |
| 2,013,247 | 9/1935 | Nash | 366/343 X |
| 2,930,596 | 3/1960 | Waters | 366/279 |
| 2,964,301 | 12/1960 | Bosse | 366/329 |
| 3,134,549 | 5/1964 | Quackenbush et al. | 366/605 X |
| 3,207,488 | 9/1965 | Brasington | 366/197 |
| 4,305,670 | 12/1981 | Moskowitz et al. | 366/197 |
| 4,480,926 | 11/1984 | Lattery, Jr. et al. | 366/329 X |

*Primary Examiner*—Philip R. Coe
*Attorney, Agent, or Firm*—Henderson & Sturm

[57] ABSTRACT

A novel rotor is provided for attachment to the lower end portion of the motor-driven shaft of a liquid-mixing device, such as a liquifier or mixer commonly used in the preparation of milkshakes, malts and like ice cream mixes. The rotor features a one-piece element in the form of a V having a flat bottom and a pair of upwardly and outwardly divergent arms providing mixing blades related in diametrically opposed fashion. A disk having a central opening receives the shaft and is disposed in radial plane spaced axially above the flat bottom and its periphery is affixed to the terminal upper ends of the blade arms. The disk has an annular flange which presents a smooth circular surface that prevents the blades from damaging the mix container during operation of the mixer as well as during removal of the container while the shaft and rotor are still rotating.

7 Claims, 6 Drawing Figures

Fig. 1
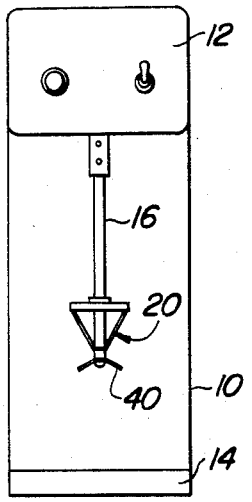
Fig. 2
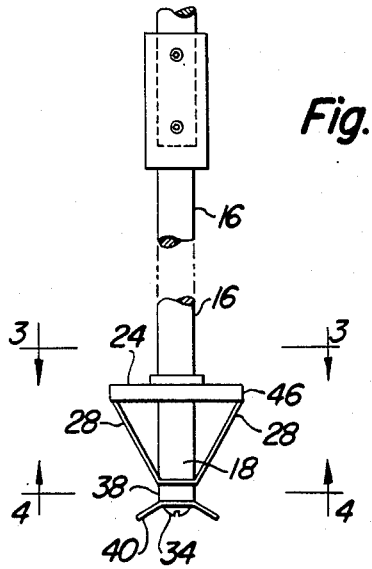
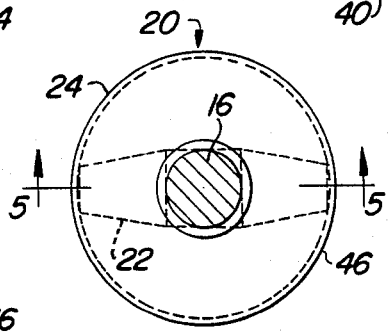
Fig. 3
Fig. 5
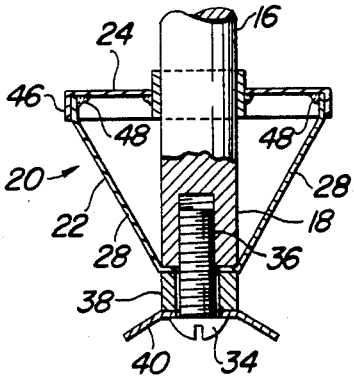
Fig. 6
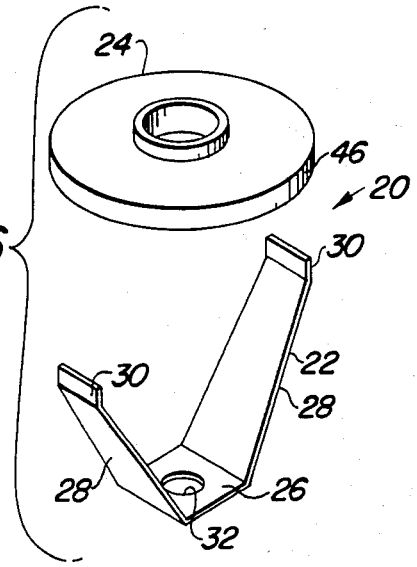
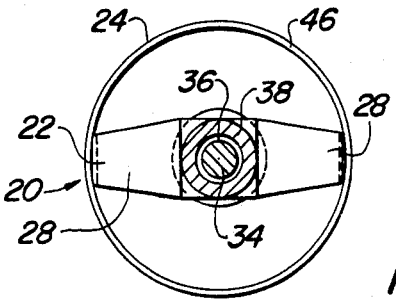
Fig. 4

ROTOR FOR LIQUID MIXING DEVICE

BACKGROUND AND SUMMARY OF THE INVENTION

The invention relates to improvements in rotor for affixation to the lower ends of vertical, motor-driven shafts such as found in mixers or liquifiers commonly used for the preparation of milkshakes, malts, ice cream drinks and the like. A mixer shaft of this type will turn at high speed, usually in the order of 3,000 to 10,000 RPM as a suitable container is positioned in such manner that the shaft and rotor extend within the container to mix the contents. Many forms of rotors are and have been used, all designed to produce various types of mixing actions. In one example in particular, such as disclosed in the U.S. patent to Moskowitz, U.S. Pat. No. 4,305,670, the rotor is in the form of a truncated conical member mounted coaxially on the end of the shaft and having upwardly convergent ribs said to produce a certain mixing action. The rotor in the patent is made of a plastic material and has a lower annular edge so as to avoid damaging the container, especially during removal of the container from the shaft while the shaft is still turning at high speed.

According to the present invention, an improved rotor is provided having diametrically opposed blades that extend in upwardly and outwardly divergent fashion from the lower end of the shaft. Blades of this type are subject to substantial centrifugal force and would tend to extend radially during operation, increasing the possibility of damaging the container and even causing injury to the hand of the user holding the container in the use of paper or paper-like containers. To avoid these possibilities and to augment the mixing action, the improved rotor includes a disk having a central opening receiving the shaft and disposed in a plane normal to the shaft axis and spaced above the lower end of the shaft. The periphery of this disk is affixed, as by welding in the instance in which the material is stainless steel, for example, to the upper ends of the divergent arms. The disk has an annular flange surrounding the attached upper ends of the blade arms and presents a smooth annular edge or surface. The blade arms lie on or within the surface of an inverted truncated right regular cone having the disk as its base. Thus the blade arms do not project beyond the surface of this cone and therefore cannot damage the container even if contact is made.

The rotor can be constructed for use with mixers of known designs and is easily attached for use and detached when necessary. Further features will appear as the disclosure continues.

DESCRIPTION OF THE DRAWINGS

FIG. 1 is a small-scale view showing a typical mixer as including the improved rotor.

FIG. 2 is an enlarged elevation, with portions broken away, of the shaft and rotor.

FIG. 3 is a section on the line 3—3 of FIG. 2.

FIG. 4 is a section along the line 4—4 of FIG. 2.

FIG. 5 is a section along the line 5—5 of FIG. 3.

FIG. 6 is an "exploded" two-part view of the rotor elements.

DESCRIPTION OF A PREFERRED EMBODIMENT OF THE INVENTION

In FIG. 1, which is representative of a typical background structure, a mixer is designated at (10) as having an upper housing part (12) containing a high-speed electric motor (not shown). The unit (10) further includes a base (14) for conventional support of the unit. Depending from the motor housing is a shaft (16) rotatable about a vertical axis, usually at speeds of between 1,000 to 10,000 RPM. This shaft has a lower end portion (18) to which is affixed a rotor, designated in its entirety by the numeral (20). By way of orientation as to dimensions, and only as representative, the shaft may be of approximately one-half inch diameter stainless steel; the outside diameter of the rotor, which may be likewise of stainless steel, is on the order of one and three-fourths inches and its vertical dimension is approximately one and one-fourth inches.

In its preferred form, the rotor is composed of two basic parts, a blade element (22) and a top member in the form of a disk (24). See FIG. 6. The blade element has a flat bottom (26) from which two blade arms (28) extend in diametrically opposite, upwardly and outwardly diverging relationship as aspects a vertical axis. As will be seen presently, when the rotor is positioned on the mixer shaft, this axis and the shaft axis are coincident. The blade arms are preferably integral with the flat bottom and terminate respectively in terminal upper ends (30) which are coplanar in a plane normal to the aforesaid axis. The flat bottom nas a central opening (32) which, when the rotor is completed and assembled to the shaft, receives a slotted screw or like fastener (34) which in turn threads upwardly into an axial tapped bore (36) in the lower end of the shaft, passing before that through a drilled spacer (38) interposed between the flat bottom (26) and a typical mixer "rosette" (40).

The top member or disk (24) has a central circular opening (42) sized to receive the mixer shaft and this opening is surrounded by a hub (44) to fit the shaft. The disk is bordered by an integral depending annular flange (46) and the upper ends (30) of the blade arms are rigidly affixed, as by welding at (48) (FIG. 5). In the preferred design shown here, the flange may have a vertical dimension of three-sixteenths of an inch, and the disk stock, as well as that of the blade element may be on the order of one-thirty-second to three-sixty-fourths of an inch thick. Welding of the blade arm ends to the interior periphery of the disk flange assures that these ends are circumscribed by the flange, thus presenting an exterior, annular, smooth edge or surface which cannot adversely affect the container used with the rotor and shaft. Stated otherwise, the blade arms lie on or within the surface of an inverted, truncated right regular cone having the disk as its base and the shaft axis as its own axis. The blade element is preferably formed of strip stock, shaped substantially as shown, preferably giving the arms a slight upward taper (FIGS. 3, 4 and 6).

The unitized disk and blade element form an efficient, sturdy, low-cost rotor in which the blade arms serve to adequately handle heavier or semi-solid liquids, such as ice cream, as well as other ingredients entering into the end product. The rotor reduces the load on the rosette. The disk, as already stated, secures the blade arms against "flying out" under the action of centrifugal force.

It will be understood that the foregoing covers a preferred form of invention, incorporating the features pointed out. Other features will occur to those versed in the art, as will many modifications and alterations in the design and structure, all of which may be achieved without departure from the spirit and scope of the invention.

I claim:

1. In a mixer of the class described, including an upright motor-driven shaft rotatable about a vertical axis and having a lower end portion, and a mixer rotor affixed to said lower end portion, the improvement in which the rotor comprises a blade element substantially in the form of a V having a flat bottom disposed diametrically across the lower end portion of the shaft, said blade element continuing in upward and outward divergent fashion from said flat bottom as blade arms symmetrical to the shaft at diametrically opposite sides thereof, each arm having an upper end and said ends lying in a common plane normal to the shaft axis, and a circular top member, concentric with the shaft and lying essentially in said plane, said member having a diameter on the order of the diametrical spacing between the upper ends of the arms and connected at its periphery to said upper ends and said periphery presenting a smooth annular surface.

2. In a mixer as set forth in claim 1, the further improvement residing in that the top member is a disk having a central opening coaxially receiving the shaft, and joined at diametrically opposite portions of its periphery to said upper ends.

3. The mixer of claim 2, the further improvement residing that the blade arms lie essentially on the surface of an inverted right regular truncated cone having the shaft axis as its axis and the disk as its base.

4. The mixer of claim 3, the further improvement in which the disk has an integral, depending annular flange and the upper ends of the blade element are joined to said flange.

5. The mixer of claim 4, the further improvement in which the upper ends of the blade element are joined to the inner periphery of said flange.

6. The mixer of claim 2, the further improvement in which the disk has a central hub secured thereto and fitting the shaft.

7. The mixer of claim 2, the further improvement in which the lower end portion of the shaft has an axial tapped bore therein, the flat bottom of the blade element has an opening therein axially alined with the bore, and a threaded fastener member extends through said opening and is threaded into said bore.

* * * * *